US011186411B2

(12) United States Patent
Galsgaard

(10) Patent No.: US 11,186,411 B2
(45) Date of Patent: Nov. 30, 2021

(54) THERMOFORMED PLASTIC CONTAINER

(71) Applicant: Faerch A/S, Holstebro (DK)

(72) Inventor: Jørn Galsgaard, Vemb (DK)

(73) Assignee: FAERCH A/S, Holstebro (DK)

( * ) Notice: Subject to any disclaimer, the term of this patent is extended or adjusted under 35 U.S.C. 154(b) by 0 days.

(21) Appl. No.: 16/484,646

(22) PCT Filed: Jan. 16, 2018

(86) PCT No.: PCT/DK2018/050008
§ 371 (c)(1),
(2) Date: Aug. 8, 2019

(87) PCT Pub. No.: WO2018/145708
PCT Pub. Date: Aug. 16, 2018

(65) Prior Publication Data

US 2020/0002057 A1 Jan. 2, 2020

(30) Foreign Application Priority Data

Feb. 13, 2017 (DK) ..... PA 2017 70093

(51) Int. Cl.
*B65D 21/02* (2006.01)
*B65D 1/34* (2006.01)

(52) U.S. Cl.
CPC ..... *B65D 21/0233* (2013.01); *B65D 1/34* (2013.01)

(58) Field of Classification Search
CPC . B65D 21/0233; B65D 21/02; B65D 21/0213
See application file for complete search history.

(56) References Cited

U.S. PATENT DOCUMENTS 3,353,708 A * 11/1967 Davis ..... B65D 51/1666 206/519
3,529,743 A * 9/1970 Ehrbar ..... B65D 21/0233 220/659
3,530,917 A * 9/1970 Donovan ..... B65D 21/0233 220/359.1
2004/0126218 A1 7/2004 Padovani
2005/0011898 A1 1/2005 Van Handel et al.
2011/0139660 A1 6/2011 Cabell et al.
2012/0005994 A1 6/2012 Tidball et al.

OTHER PUBLICATIONS

International Search Report dated Mar. 15, 2018 from PCT Priority Application PCT/DK2018/050008 (3 pages).
Written Opinion dated Mar. 15, 2018 from PCT Priority Application PCT/DK2018/050008 (5 pages).
International Preliminary Report on Patentability dated Aug. 13, 2019 from PCT Priority Application PCT/DK2018/0500 (6 pages).

* cited by examiner

*Primary Examiner* — Andrew T Kirsch
(74) *Attorney, Agent, or Firm* — Crowell & Moring LLP; John C. Freeman

(57) ABSTRACT

A thermoformed plastic container (1) is disclosed, comprising a secondary recess (4) extending along the full circumference of the container externally to a sealing flange (3) at the top of a side wall (2) of the container, wherein the container is designed in such a way that, when two such containers are stacked on top of each other, the secondary recess of the uppermost of the two containers rests on the lowermost of the two containers.

19 Claims, 10 Drawing Sheets

THERMOFORMED PLASTIC CONTAINER

Figure 1:
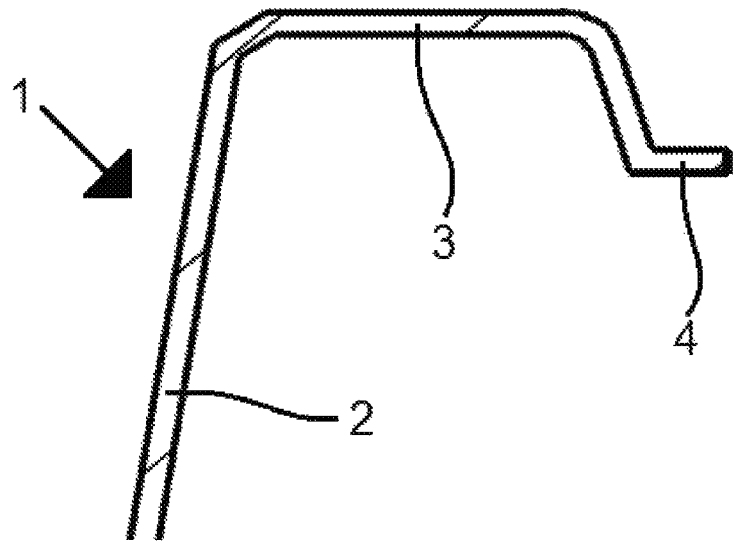

This application claims the benefit under 35 U.S.C. § 371 of International Application No. PCT/DK2018/050008, filed Jan. 16, 2018, which claims the priority of Danish Patent Application No. PA 2017 70093, filed Feb. 13, 2017; which are incorporated by reference herein in their entirety.

The present invention relates to a thermoformed plastic container, for instance to be used for foodstuffs.

BACKGROUND OF THE INVENTION

It is well-known to pack different kinds of foodstuff into containers made from a plastic material. In the filling process, such containers are typically mechanically denested (unstacked) from the bottom of a stack of containers from where they fall onto a moving conveyor taking them to a filling station and further to a sealing station.

In such a stack of containers, two vertical measures are important. The first of those measures is the so-called stacking height, which can be defined as the vertical distance between a given point on a first container and the corresponding point on a second container, which is positioned immediately above or beneath the first container in the stack. The minimum obtainable stacking height, which is decisive for the maximum number of containers in a stack of a given height, is defined by the slope of the side walls of the containers and by the thickness of the sheet of plastic, from which the containers are produced. With most containers known within the art, the minimum obtainable stacking height is about 2.5 mm.

The other important vertical measure is the vertical gap between any two consecutive containers in the stack along at least a part of the circumference of the containers, because this vertical gap is used by mechanical systems used for denesting the containers from the stack one after the other. Thus, for such denesting systems to function properly, it is important that these vertical gaps are uniformly distributed along the full height of the stack, so that the position of each vertical gap is predictable and can be found by the denesting system. It is, however, often difficult to obtain the necessary uniform distribution of these vertical gaps, because the edges of the containers, especially near the ends thereof, often tend to warp or otherwise deviate from the desired shape and position, primarily due to the weight of the containers positioned higher in the stack. This means that the position of the edges of the containers and, thereby, of the vertical gaps vary unpredictably and that sometimes the vertical gaps are not "found" correctly by the mechanical denesting systems. This, in turn, may result in the denesting of more than one container at a time and/or in containers being erroneously positioned on a running conveyor below the stack.

BRIEF DESCRIPTION OF THE INVENTION

It is an object of the present invention to provide a thermoformed plastic container, which is designed in such a way that the above-defined vertical gap between any two consecutive containers in a stack of such containers is significantly more uniform than in stacks of containers known within the art.

The present invention relates to a thermoformed plastic container comprising a secondary recess extending along the full circumference of the container externally to a sealing flange at the top of a side wall of the container, wherein the container is designed in such a way that, when two such containers are stacked on top of each other, the secondary recess of the uppermost of the two containers rests on the lowermost of the two containers.

Letting the secondary recess, i.e. the outermost part along the edge of the container, rest onto the beneath container is advantageous, because it stabilizes the edges of the container outside the sealing flange. In general, the expression "secondary recess" in the present document refers to all parts of the container, which are external to the upward-facing surface of the sealing flange. Especially in or near the corners of the container, this significantly increases the rigidity of the secondary recess of a stacked container by "locking" it against the above and/or the beneath container. This means that the warping and other deviations of the shape of the edge are significantly reduced, which causes the positions of the edges of the containers within the stack and, thereby, also of the vertical gaps between these containers to be significantly more predictable than is the case for stacks of containers known within the art. This means, in turn, that these vertical gaps, and thereby also the stacking heights, within the stack can be made much smaller in stacks of containers according to the present invention without risking that the mechanical denesting system will miss the vertical gaps when denesting the containers from the stack.

In an embodiment of the invention, the container further comprises one or more denesting features arranged on the secondary recess, wherein the one or more denesting features are designed in such a way that, when two such containers are stacked on top of each other, the secondary recess of the uppermost of the two containers rests on the denesting features of the lowermost of the two containers.

The use of denesting features arranged on the secondary recess of a container is a reliable way of making sure that the secondary recess of the above container in a stack rests securely thereon. Furthermore, it makes it easy to control the size of the vertical gap and the stacking height in a stack of such containers.

In an embodiment of the invention, each of the one or more denesting features consists of an elongated upward protrusion from the secondary recess extending along a part of the sealing flange in close vicinity thereof.

This design of the denesting features is optimal for producing such denesting features in a thermoforming process.

In an embodiment of the invention, the heights of the one or more denesting features are less than 3 mm, preferably less than 1.5 mm.

In an embodiment of the invention, the widths of the one or more denesting features are less than 3 mm, preferably less than 2 mm.

In an embodiment of the invention, the lengths of the one or more denesting features are more than 3 mm, preferably between 8 mm and 40 mm.

In an embodiment of the invention, the one or more denesting features are provided with undercuts causing the widths of the one or more denesting features to be smaller at the bottoms thereof than at the tops thereof.

The use of such undercuts increases the areas of the overlapping parts of a secondary recess of a first container and the denesting features of a second container, on top of which the first container is stacked. This increases the stability of the stack of containers of which the first and the second containers form part.

In an embodiment of the invention, at least along a part of the circumference of the container, the sealing flange and the secondary recess are designed in such a way that their horizontal surfaces overlap one another.

By letting the horizontal surfaces of the sealing flange and the secondary recess overlap each other, it is obtained that the secondary recess of a given stacked container will rest onto the sealing flange of the beneath container in the stack.

In an embodiment of the invention, the horizontal surfaces of the sealing flange and the secondary recess, respectively, overlap each other at least in the corners of the container.

In an embodiment of the invention, the thermoformed plastic container further comprises one or more denesting knobs, each of which denesting knobs consists of an outward and downward directed recess positioned at the edge between the side wall and the sealing flange of the container, internally to the sealing flange.

The use of denesting knobs, for instance in the corners of the container, in combination with the denesting features on the secondary recess, it can be further ensured that containers in a stack are not pressed together, which could cause the vertical gaps and the stacking heights to vary across the height of the stack.

THE DRAWINGS

Figure 2:
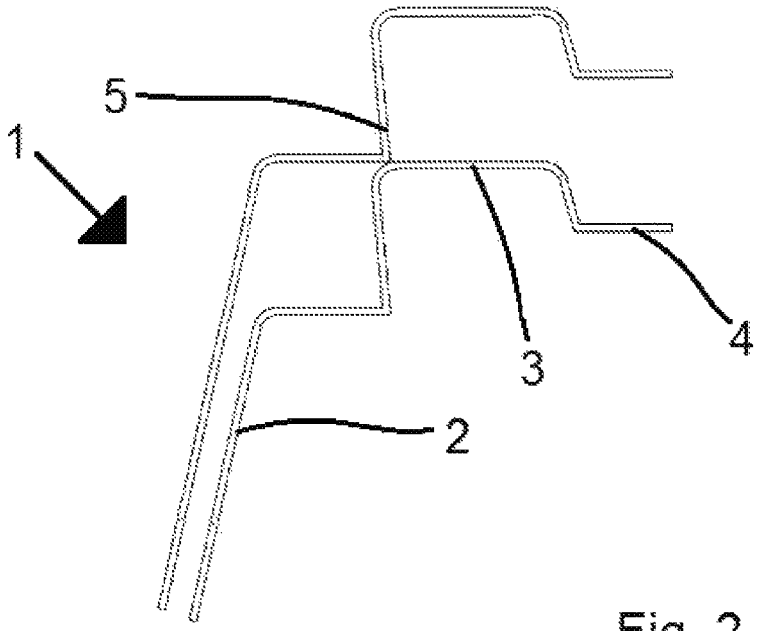
Figure 3:
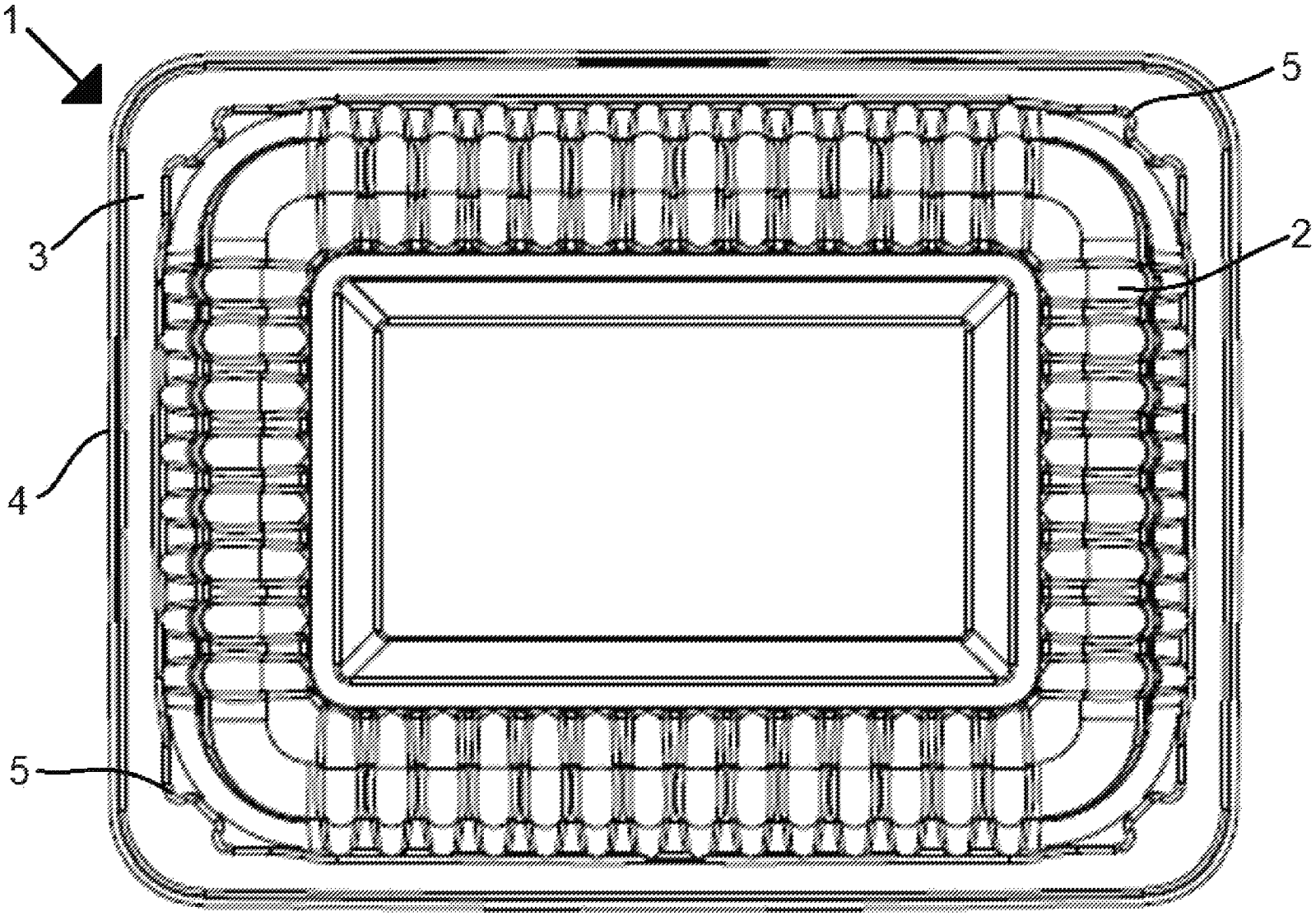
Figure 4:
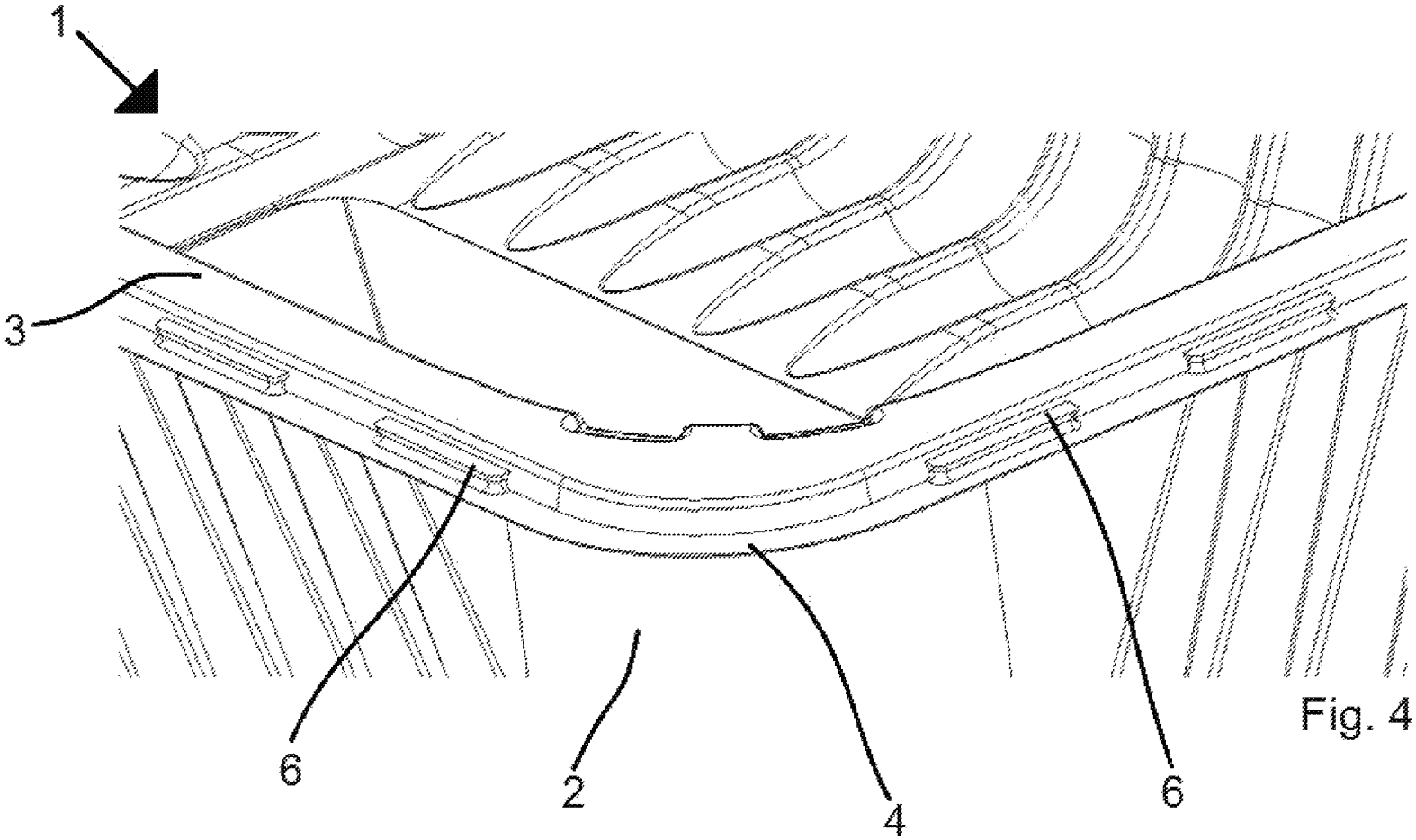
Figure 5:
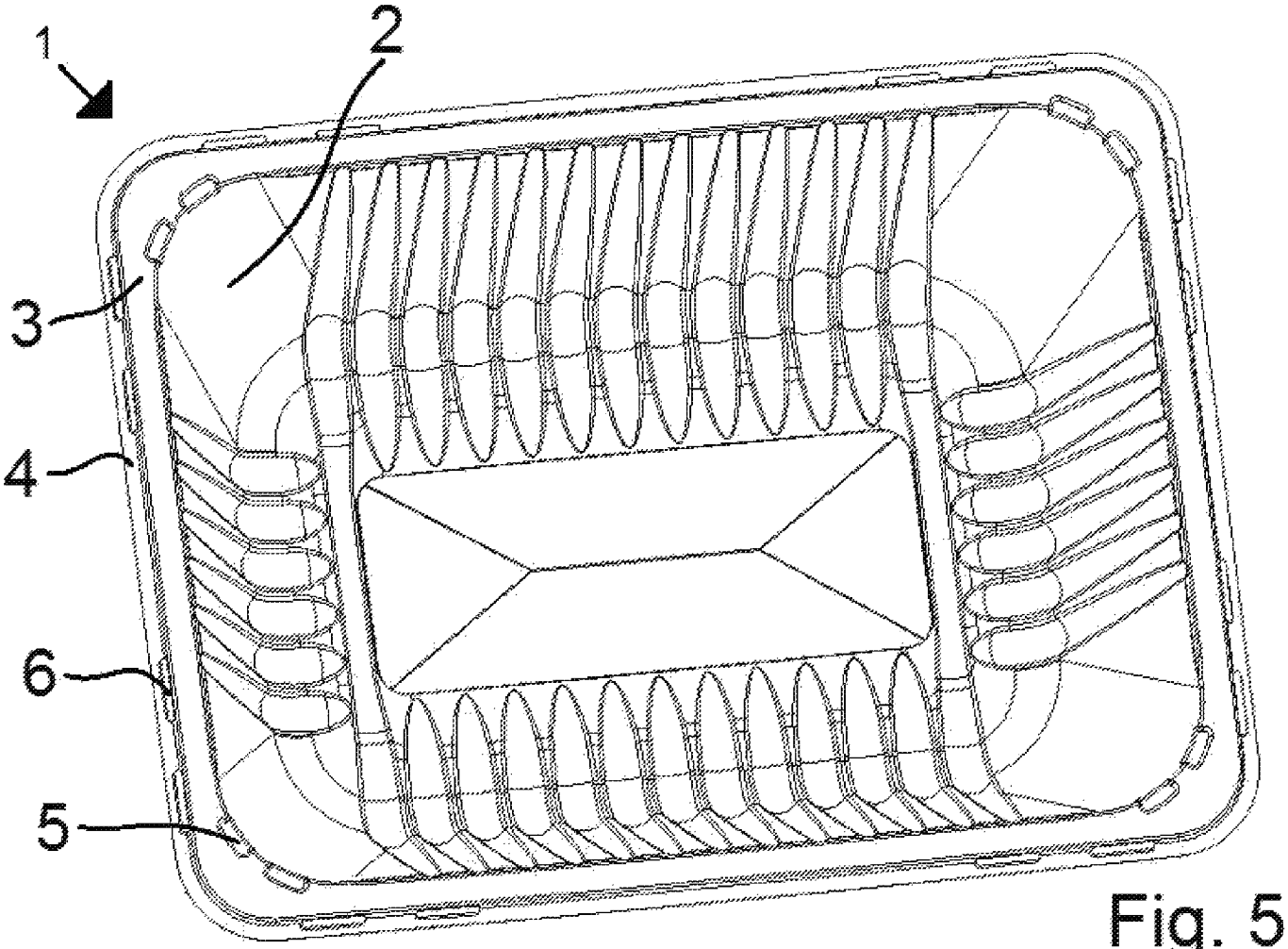
Figure 6:
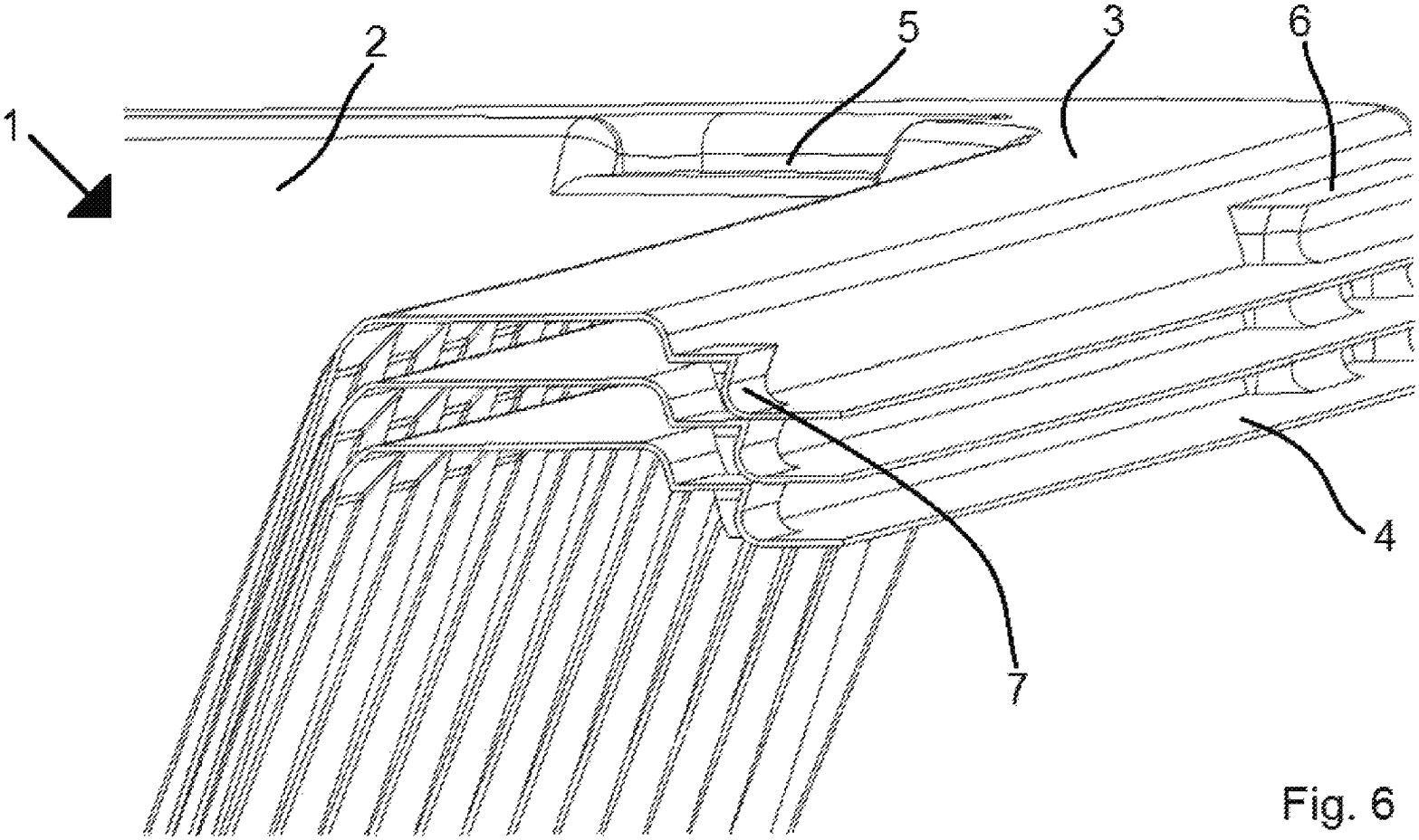
Figure 7:
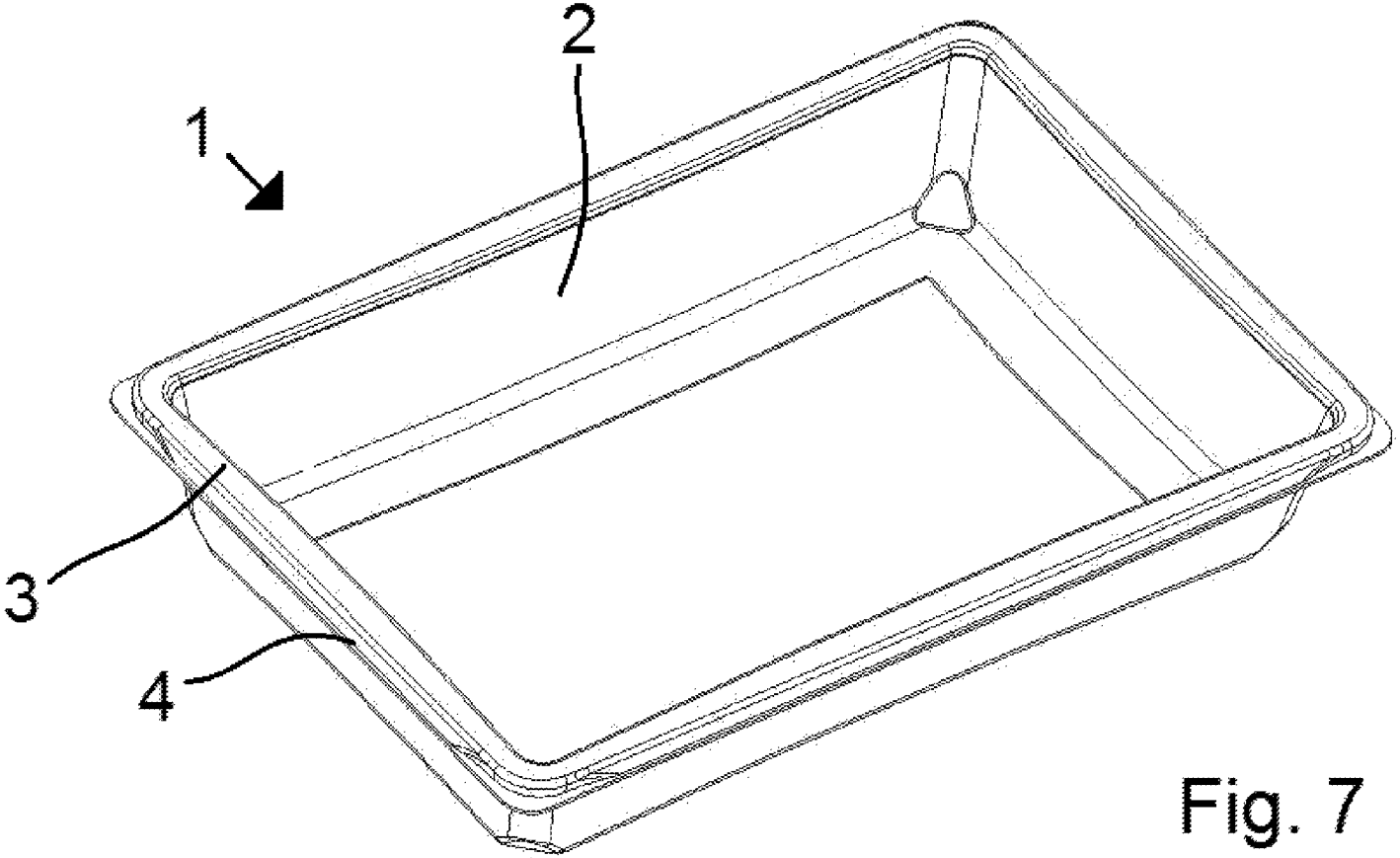
Figure 8:
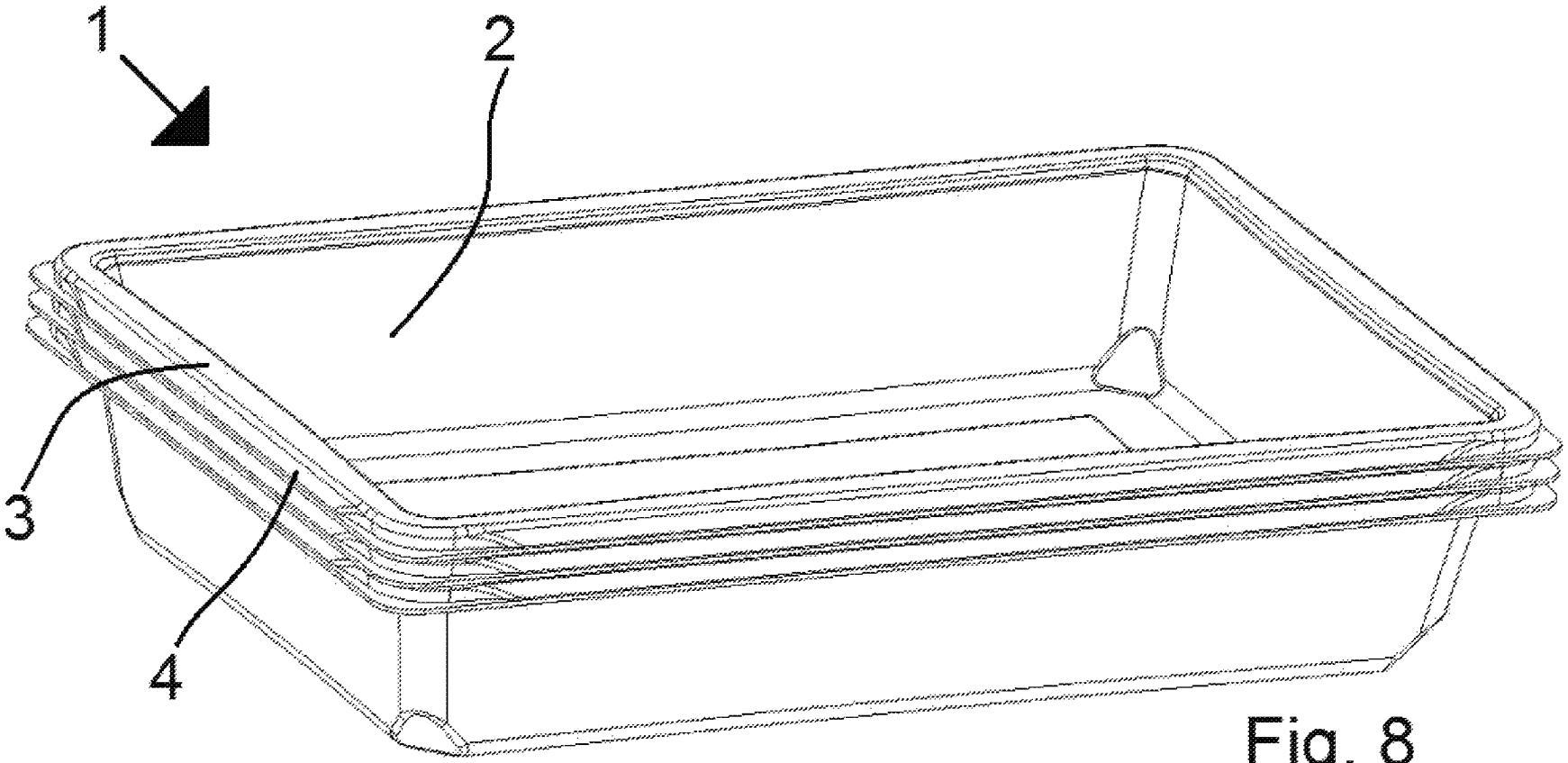
Figure 9:
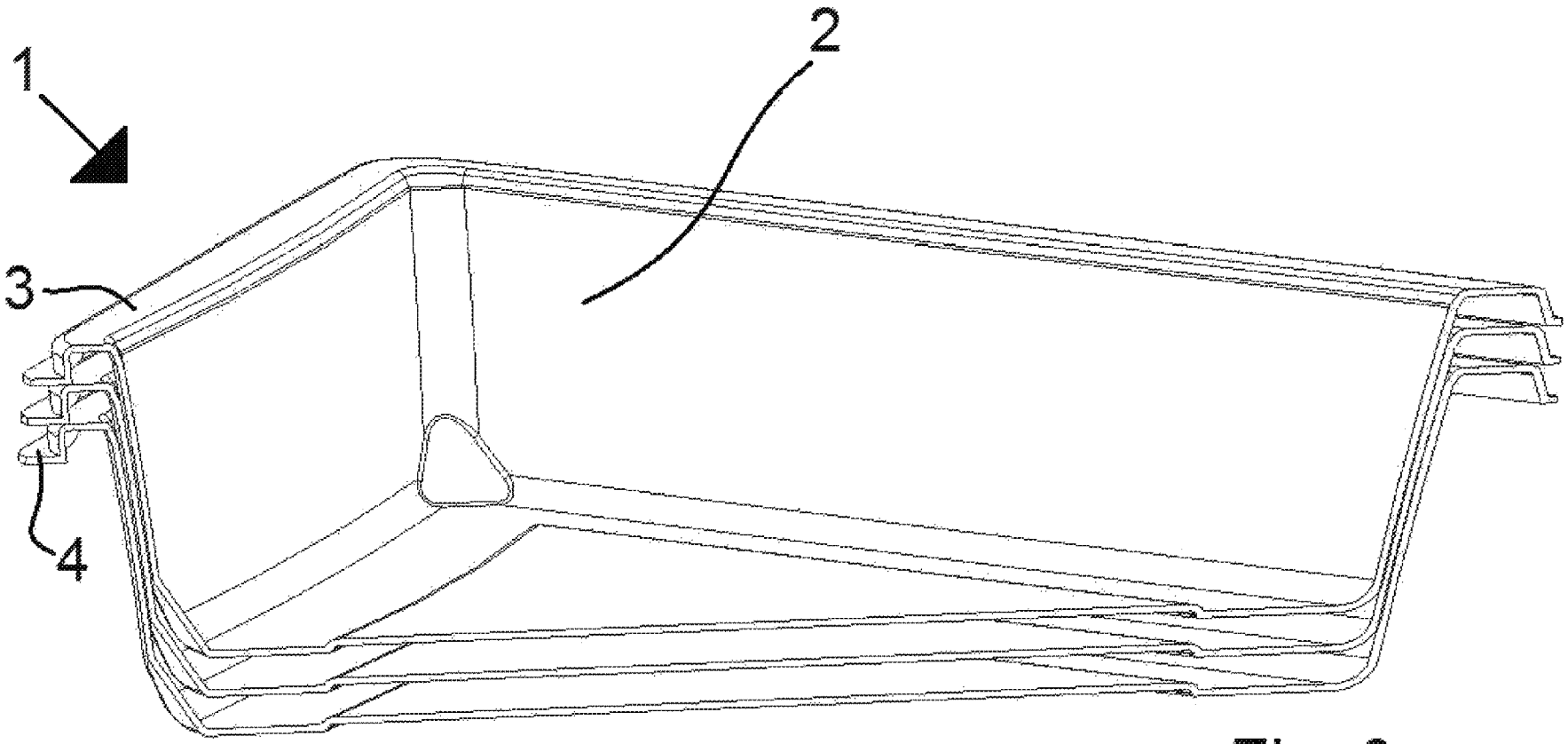
Figure 10:
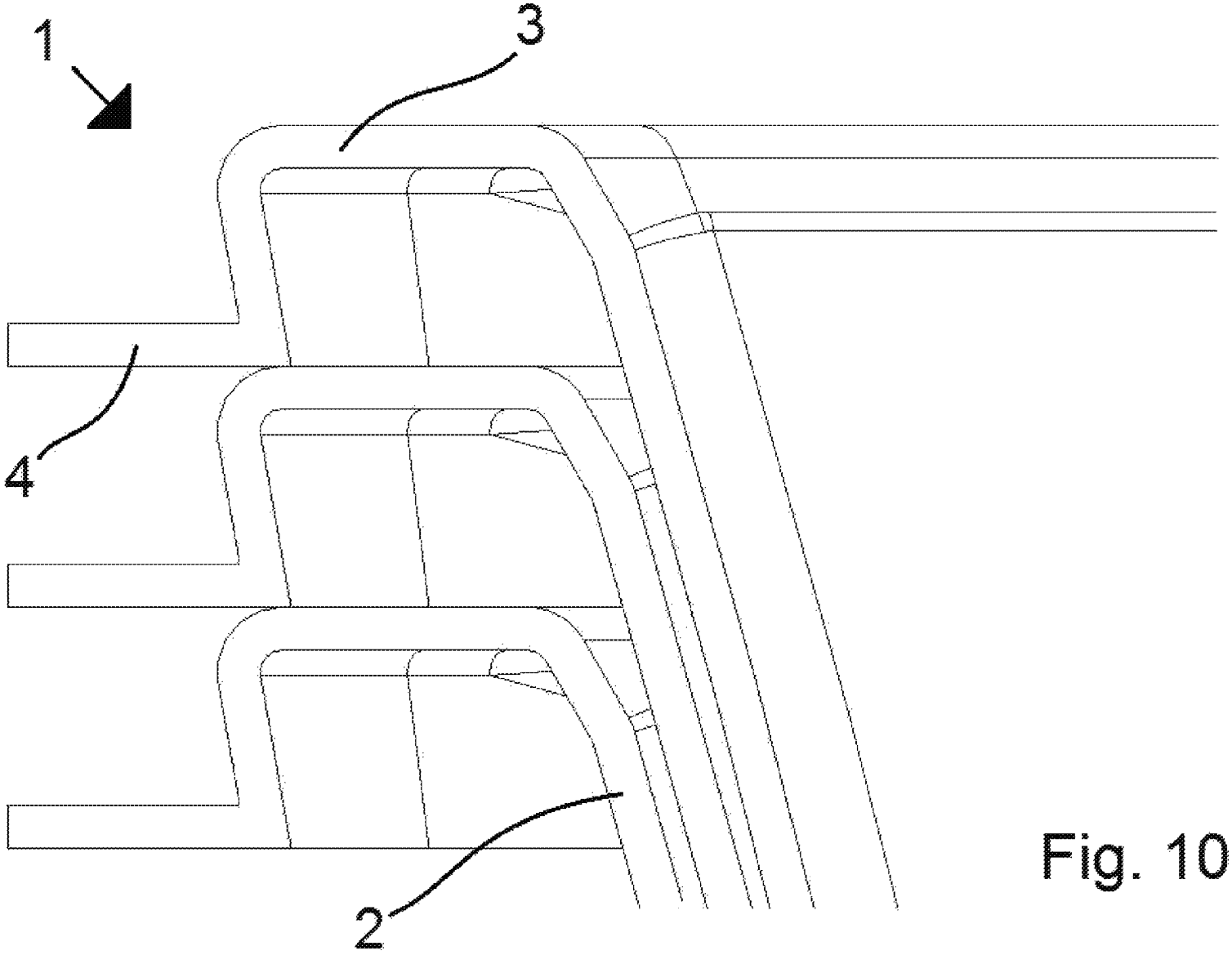
Figure 11:
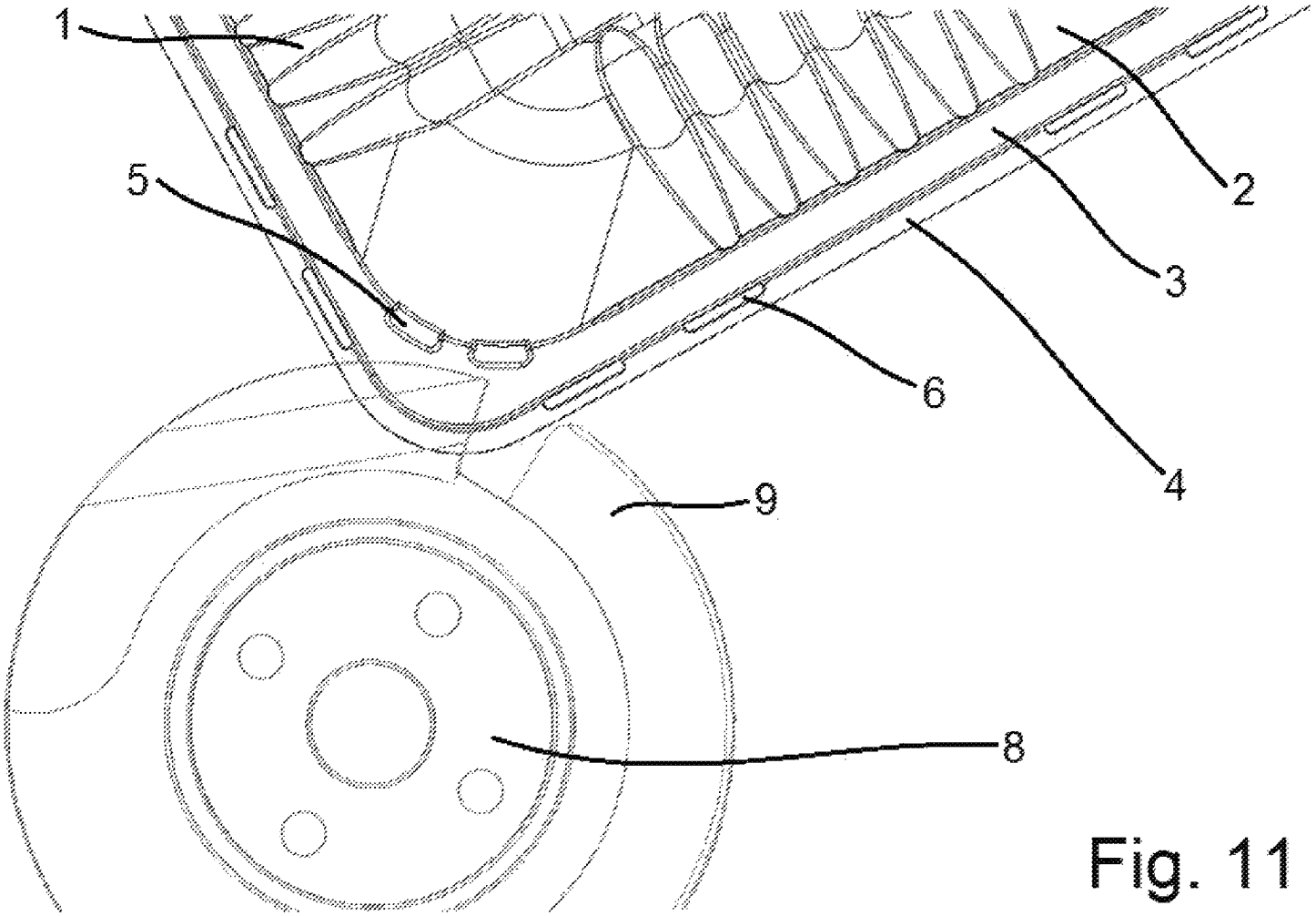

In the following, a few exemplary embodiments of the invention are described in further detail with reference to the figures, of which FIG. 1 is a schematic cross-sectional view of the edge of a first type of plastic container known within the art, FIG. 2 is a schematic cross-sectional view of the edges of two stacked plastic containers according to a second type of plastic container known within the art, FIG. 3 is a top view of a plastic container of the type shown in FIG. 2, FIG. 4 is a perspective view of a plastic container according to a first embodiment of the invention, FIG. 5 is an oblique top view of a plastic container according to the first embodiment of the invention, FIG. 6 is a perspective view of a part of a cut-through stack of containers according to the first embodiment of the invention, FIG. 7 is a perspective view of a plastic container according to a second embodiment of the invention, FIG. 8 is a perspective view of three stacked plastic containers according to the second embodiment of the invention, FIG. 9 is a schematic cross-sectional view through the three stacked plastic containers shown in FIG. 8, FIG. 10 is an enlarged part of FIG. 9 illustrating the cross-section through a corner of the three stacked plastic containers shown in FIGS. 8 and 9, and FIG. 11 illustrates schematically a part of a mechanism for denesting containers according to different embodiments of the invention.

DETAILED DESCRIPTION OF THE INVENTION

FIG. 1 is a schematic cross-sectional view of the edge of a first and relatively simple type of plastic container 1 known within the art. The figure shows the upper part of the side wall 2 of the container, the sealing flange 3 and the secondary recess 4.

FIG. 2 is a schematic cross-sectional view of the edges of two plastic containers 1 according to a second type known within the art. The containers 1 illustrated in FIG. 2 differ from the one illustrated in FIG. 1 in that they comprise a so-called denesting knob 5, which is an outward and downward directed recess positioned at the edge between the side wall 2 and the sealing flange 3 and through which the illustrated cross-section passes. FIG. 2 illustrates clearly, how the denesting knobs 5 ensure a certain vertical distance between two neighbouring containers 1 in a stack. As mentioned above, this is important for enabling a mechanical denesting of the containers 1 from the stack, because the denesting mechanism needs access to a vertical gap between the containers 1 in order to separate the containers 1 from each other.

Thus, a certain vertical gap is necessary, whereas a too large vertical gap is undesired because this implies a large stacking height, too, and the number of containers 1 in a stack of a certain height decreases with increasing stacking heights. This means that the optimal vertical gap is the one, which is exactly large enough to enable mechanical denesting.

Normally, denesting knobs 5 as illustrated in FIG. 2 do not extend all the way around the container 1. Rather, the lengths of the denesting knobs 5 are relatively limited and the denesting knobs 5 are placed at certain advantageous positions along the periphery of the container 1, such as in or near the corners thereof as illustrated in FIG. 3, which is a top view of a plastic container 1 of the same type as shown in FIG. 2.

FIG. 4 is a perspective view of a plastic container 1 according to a first embodiment of the invention. This container 1 comprises a number of denesting features 6 arranged on the secondary recess 4, i.e. externally to the sealing flange 3 rather than internally to the sealing flange 3 as is the case for the denesting knobs 5 illustrated in FIGS. 2 and 3. The use of such denesting features 6 on the secondary recess 4 is advantageous for at least two reasons:

Firstly, it increases the rigidity of the secondary recess 4, so that the risk of secondary recesses 4 of two neighbouring containers 1 in a stack being squeezed together is significantly reduced. This is important for enabling the denesting mechanism to separate the containers 1, especially if the vertical gap is as small as is obtainable with containers 1 according to the present invention.

Secondly, it makes it possible to obtain containers 1, which can be stacked with a significantly smaller stacking height than containers 1, the stacking height of which is defined by denesting knobs 5 as described above. Whereas stacking heights of containers 1 known in the art are typically at least 2.5 mm, the use of denesting features 6 on the secondary recess 4 allows for stacking heights down to 1 mm or even lower.

Just like the internally positioned denesting knobs 5 known in the art, the denesting features 6 on the secondary access 4 do not necessarily extend all the way around the container 1. Rather, the lengths of the denesting features 6 are also relatively limited and the denesting features 6 are placed at certain strategic positions along the periphery of the container 1, such as near the corners thereof. As illustrated in FIG. 5, however, a certain distance to the corner is maintained in order to allow a denesting mechanism to access the space between two neighbouring containers 1 at the corners thereof.

FIG. 5 is an oblique top view of a plastic container 1 according to the first embodiment of the invention, which comprises both internal denesting knobs 5 and external denesting features 6 as described above.

FIG. 6 is a perspective view of a part of a cut-through stack of three containers 1 of the type shown in FIG. 5. This figure illustrates, how the vertical gap is defined by the secondary recess 4 of a given container 1 resting on the denesting features 6 of the container 1 just beneath it.

FIG. 6 further illustrates how the denesting features 6 may be provided with an undercut 7, which increases the areas of the overlapping parts of a secondary recess 4 of a first container 1 and the denesting features 6 of a second container 1, on top of which the first container 1 is stacked. This increases the stability of the stack of containers 1 of which the first and the second containers 1 form part. The stability of the stack can be improved even further by using two or more different variations of the container 1, in which the positions and extents of the denesting features 6 do not coincide. In this way, it can be avoided that only the edges of the denesting features 6 of a given container 1 rest upon the denesting features 6 of the beneath container 1.

FIG. 7 is a perspective view of a plastic container 1 according to a second embodiment of the invention, in which the sealing flange 3 and the secondary recess 4 are designed in such a way that their horizontal surfaces overlap one another in the corners of the container 1. This ensures that, in the corners of the containers 1, the secondary recess 4 of a stacked container 1 will rest securely onto the sealing flange 3 of the beneath container 1 in the stack as illustrated in FIG. 8, which is a perspective view of three such stacked plastic containers 1.

FIG. 9 is a schematic cross-sectional view through the three stacked plastic containers 1 shown in FIG. 8, the part of which cross-section passing through a corner of the three containers 1 is enlarged in FIG. 10. FIG. 9 and, especially, FIG. 10 illustrate how the corners of the containers 1 according to this embodiment of the invention rest upon the corners of the beneath container 1, when such containers 1 are stacked.

FIG. 11 illustrates schematically a part of an example of a mechanism for denesting containers 1 according to different embodiments of the invention. The mechanism comprises a number of denesting screws 8, one of which is illustrated schematically in the figure. Typically, the mechanism comprises four such denesting screws 8 arranged at the four corners of the stack of containers 1, respectively.

Each denesting screw 8 comprises a denesting screw thread 9 consisting of a part of a full screw thread, typically approximately a quarter of a full screw thread or half a full screw thread. By synchronously rotating the denesting screws 8 of the denesting system, the denesting screw threads 9 can be moved into the space between two neighbouring containers 1 and the inclining denesting screw threads 9 force the two containers 1 away from each other, after which the denesting screws 8 can be rotated back to their initial positions, either by continuing in the same rotational direction or by reversing the rotation of the denesting screws 8. If this is done between the two lowermost containers 1 in a stack, the lowermost container 1 will be forced to fall off the stack, for instance down onto a moving conveyor taking it to a filling station and further to a sealing station.

LIST OF REFERENCE NUMBERS

1. Thermoformed plastic container
2. Side wall
3. Sealing flange
4. Secondary recess
5. Denesting knob
6. Denesting feature
7. Undercut in denesting feature
8. Denesting screw
9. Denesting screw thread

The invention claimed is:

1. A thermoformed plastic container comprising:

a side wall and a sealing flange at a top of the side wall;

a secondary recess extending along a full circumference of the container externally to the sealing flange and multiple denesting features arranged on the secondary recess in line along the sealing flange and extending along a part of the sealing flange in close vicinity thereof, wherein the container is designed in such a way that, when two such thermoformed plastic containers are stacked on top of each other, the secondary recess of an uppermost of the two thermoformed plastic containers partly rests on the multiple denesting features of a lowermost of the two thermoformed plastic containers, such that a vertical gap between the secondary recess of the two stacked thermoformed plastic containers is achieved.

2. The thermoformed plastic container according to claim 1, wherein the denesting feature comprises an elongated upward protrusion from the secondary recess extending along a part of the sealing flange in close vicinity thereof.

3. The thermoformed plastic container according to claim 2, wherein a height of the denesting feature is less than 3 mm.

4. The thermoformed plastic container according to claim 3, wherein a width widths of the one or more denesting features are less than 3 mm.

5. The thermoformed plastic container according to claim 3, wherein a width of the denesting feature is less than 2 mm.

6. The thermoformed plastic container according to claim 3, wherein a length of the denesting feature is more than 3 mm.

7. The thermoformed plastic container according to claim 3, wherein the denesting feature comprises an undercut causing a width of the denesting feature to be smaller at a bottom thereof than at a top thereof.

8. The thermoformed plastic container according to claim 2, wherein a width of the denesting feature is less than 3 mm.

9. The thermoformed plastic container according to claim 8, wherein a length of the one or more denesting feature is more than 3 mm.

10. The thermoformed plastic container according to claim 8, wherein the denesting feature comprises an undercut causing the width of the denesting feature to be smaller at a bottom thereof than at a top thereof.

11. The thermoformed plastic container according to claim 2, wherein a length of the denesting feature is more than 3 mm.

12. The thermoformed plastic container according to claim 11, wherein the more denesting feature comprises an undercut features are provided with undercuts causing a width of the denesting feature to be smaller at a bottom thereof than at a top thereof.

13. The thermoformed plastic container according to claim 2, wherein the denesting feature is provided with an undercut causing a width of the denesting feature to be smaller at a bottom thereof than at a top thereof.

14. The thermoformed plastic container according to claim 2, wherein a height of the denesting feature is less than 1.5 mm.

15. The thermoformed plastic container according to claim 2, wherein a width of the denesting feature is less than 2 mm.

16. The thermoformed plastic container according to claim 2, wherein a length of the denesting feature is between 8 mm and 40 mm.

17. The thermoformed plastic container according to claim 1, wherein at least along a part of the circumference of the container, the sealing flange and the secondary recess are designed in such a way that a horizontal of the sealing flange and a horizontal surface of the secondary recess overlap one another.

18. The thermoformed plastic container according to claim 17, wherein the horizontal surface of the sealing flange and the horizontal surface of the secondary recess overlap each other at least in corners of the container.

19. The thermoformed plastic container according to claim 1, further comprising a denesting knob comprising an outward and downward directed recess positioned at an edge between the side wall and the sealing flange of the container, internally to the sealing flange.

* * * * *